United States Patent [19]

Suga

[11] 3,932,784

[45] Jan. 13, 1976

[54] DOUBLE SECTION CARBON ELECTRODE

[76] Inventor: Shigeru Suga, Yoyogi 5-20-2, Shibuya, Tokyo, Japan

[22] Filed: Aug. 26, 1974

[21] Appl. No.: 500,466

[52] U.S. Cl. ..... 314/60

[51] Int. Cl.[2] ..... H05B 31/10

[58] Field of Search ..... 13/18; 314/7, 51, 60, 101, 314/130, 134; 313/346 R, 354, 355

[56] References Cited

UNITED STATES PATENTS

| | | | |
|---|---|---|---|
| 1,840,860 | 1/1932 | Wagenhorst | 314/130 X |
| 3,262,005 | 7/1966 | Riek | 314/60 X |
| 3,796,853 | 3/1974 | Matsuo et al. | 13/18 X |

*Primary Examiner*—R. N. Envall, Jr.

*Attorney, Agent, or Firm*—Wenderoth, Lind & Ponack

[57] ABSTRACT

A carbon electrode includes an elongate body having first and second sections. One section has a diameter substantially greater than the other section, and the two sections are joined by a radially extending annular shoulder.

4 Claims, 4 Drawing Figures

DOUBLE SECTION CARBON ELECTRODE

BACKGROUND OF THE INVENTION

The present invention is directed to an improved carbon electrode for use in a carbon arc lamp, particularly of the type used for weathering testers.

There are known weathering testers of the carbon arc lamp type wherein a plurality of carbon electrodes are grasped in a bottom holder which is connected to an electric source, and wherein a further plurality of carbon electrodes are held by an upper holder. The two holders are moved toward and away from each other by suitable means to permit discharge between the two groups of carbon electrodes. Samples to be subjected to weathering tests are placed around this type of arc lamp.

Known carbon electrodes employed in such devices generally have a uniform outer diameter and are comprised of carbon having a central core of a suitable luminous agent and an outer coating of a suitable metal such as copper or aluminum. When such carbon electrodes are attached to a lower holder and the lamp is discharged during use, ashes, molten oxides and molten metal will fall downwardly onto the lower holder. This results in corrosion of the contact parts of the lower holder with the obviously undesirable further result of poor quality electrical contact.

Past attempts to correct this problem have necessitated the complicated fabrication of devices such as shields to prevent such corrosion.

SUMMARY OF THE INVENTION

It is the principal object of the present invention to provide an improved carbon electrode of the type described above which eliminates the disadvantages of prior art electrodes without the necessity and expense of fabricating shielding structures.

It is a further object of the present invention to provide such an improved carbon electrode of such a nature to provide a longer electrode life while being used in previously known holders.

The above objects are achieved in accordance with the present invention by the provision of a longitudinal carbon electrode having two longitudinal sections. The first, relatively short section, has a diameter equal to that of previously known carbon electrodes and is employed as the part of the electrode to be fastened to the holder. The second relatively long section of the electrode is the discharge portion thereof and has a substantially greater diameter than the first section. Preferably, the diameter of the second section is approximately 1.8 times the diameter of the first section. The two sections are separated by a radially extending shoulder. When the electrode is assembled into the lower support of the carbon arc lamp, the radially extending shoulder covers the contact areas between the support and the first section of the electrode. Therefore, when the device is in use, and when ashes, molten oxides and molten metals fall downwardly, they are prevented from contacting the contact surfaces between the electrode and the support. This prevents the corrosion of the contact surfaces and insures a continued satisfactory electrical contact. Further, due to the fact that discharge section of the electrode has a substantially greater diameter than prior art electrodes, the life of the electrode is substantially increased, without the necessity of developing and constructing an entirely new support.

BRIEF DESCRIPTION OF THE DRAWINGS

The features of the invention will be described in more detail below with reference to the accompanying drawings wherein.

DETAILED DESCRIPTION OF THE INVENTION

Figure 1:
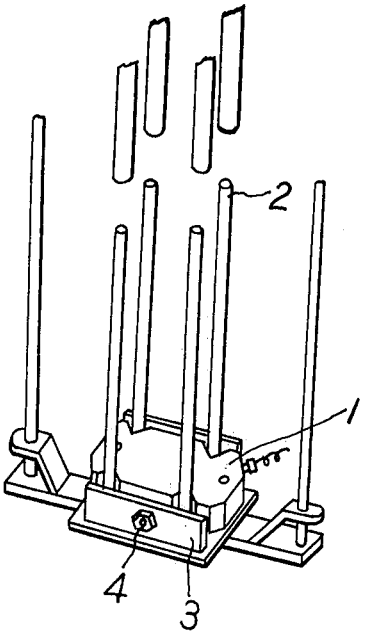
FIG. 1 is a partial perspective view of a known carbon arc lamp for use as a weather tester.

FIG. 1 illustrates a carbon arc lamp employed in a weather tester wherein discharge is created between a group of upper electrodes and a group of lower electrodes to thereby test samples of material placed around the lamp. In FIG. 1 the upper support is not shown but is substantially the same as the lower support, and means (not shown) are provided for moving the two groups of electrodes toward and away from each other to cause discharge therebetween.

With further reference to FIG. 1, a plurality, normally four, of carbon electrodes 2 are supported at the lower ends thereof in a lower support which includes a main body 1 having suitable shaped notches therein to receive the carbon electrodes and which is attached to a source of electrical power. Plates such as 3 are fastened together by fastening means 4 and press the carbon electrodes against main body 1. Normally in such devices, there are provided three contacting surfaces for holding each electrode.

Figure 2:
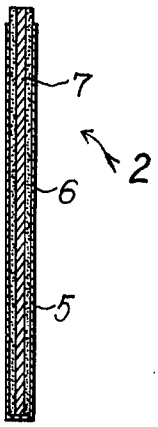
FIG. 2 is a cross-sectional view of a prior art carbon electrode used in the device of FIG. 1.

FIG. 2 illustrates in cross-section the structure of previously known carbon electrodes 2. A rod of carbon material 6 has centrally embedded therein a core 7 of a material such as a luminous agent. Surrounding the carbon 6 is a jacket 5 of a suitable material such as copper or aluminum. The upper tip of the carbon 6 is not jacketed with metal, to facilitate initiation of discharge.

Figure 4:
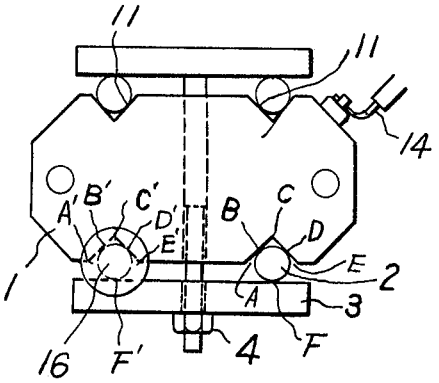
PRIOR ART Fig.4
FIG. 4 is a schematic view of a lower support of the device of FIG. 1 having connected therewith three prior art electrodes and one electrode of the present invention, thereby illustrating the effectiveness of the present invention.

With reference to the lower right-hand portion of FIG. 4, the attachment of prior art carbon electrode 2 is shown. Main body 1 of the lower support has a plurality of notches 11 about the outer edges thereof. The lower end of carbon electrode 2 is held within notch 11 by plates 3 and fastening means 4. In the embodiment of the holder illustrated, main body contacts electrode 2 at two positions, i.e. positions B and D. Plate 3 contacts carbon electrode at a single area, i.e. area F. It will be apparent that during use of the device, that is during discharge and consumption of electrode 2, ashes, molten oxides and molten metal will fall downwardly to plug up and agglomerate clearance areas A, C, and E. This results in very poor electrical contact between main body 1 and the electrode, thereby resulting in corrosion of the contact areas of the support.

Figure 3:
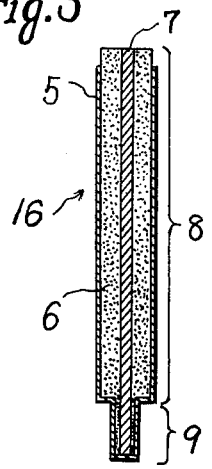
PRIOR ART Fig.3
FIG. 3 is a cross-sectional view of the improved carbon electrode of the present invention.

The above disadvantages are completely eliminated in accordance with the present invention. With reference to FIG. 3 of the drawings, an improved carbon electrode 16 includes a lower support section 9 having a diameter equal to the diameter of known carbon electrodes, e.g. 13 mm, such that the improved carbon electrode of the present invention may be used in previous supports. However, the main portion of electrode 16 of the present invention has a section 8 which has a very substantially increased diameter. Carbon element 6 in FIG. 3 is preferably a carbonaceous tube formed by extrusion molding. Preferably, the diameter of section 8 is approximately 1.8 times the diameter of section 9, i.e. the diameter of conventional carbon electrodes, e.g. 23 mm.

With reference to the lower left-hand portion of FIG. 4, the advantages of the improved carbon electrode of the present invention will become readily apparent. Carbon electrode 16 is supported at section 9 thereof in the lower support in the same manner as prior art electrode 2. However, the outer diameter of section 8 is of such a dimension that the radially extending surface joining sections 8 and 9 acts as a shield to completely cover the contact areas B′, D′ and F′ between the support and section 9. Therefore, during use, falling ashes, molten oxides, and molten metal are entirely prevented from agglomerating or plugging up clearance areas A′, C′ and E′. Accordingly, the electrical contact between the support and the carbon electrode remains regular, and the contact areas are not corroded. It will be apparent then that the operation of a weathering tester employing the carbon electrode of the present invention is much more stable than is possible employing prior art electrodes.

Even further, due to the fact that the discharge section of the carbon electrode has a substantially greater diameter, the life of the electrode will be much greater, while still being able to employ already acquired supports.

It will be apparent to those skilled in the art that many modifications of the above specifically described apparatus may be made without departing from the spirit and scope of the present invention.

What is claimed is:

1. A carbon electrode for use in carbon arc lamps of the type wherein a plurality of electrodes are clamped to a support which is connected to a power source, said carbon electrode comprising:

an elongate electrode body of carbon material having imbedded therein a core of luminous material and having about the outer surface thereof a metal coating;

said electrode body having a first section of uniform diameter and a second section of substantially greater diameter than said first section, said second section having a solid uniform thickness throughout the entire length thereof.

2. A carbon electrode as claimed in claim 1, wherein said first and second sections are joined by a radially extending annular shoulder.

3. In an arc lamp of the type including at least one carbon electrode grasped by a support to provide discrete contact areas between said support and said at least one carbon electrode, the improvement wherein said at least one carbon electrode comprises:

an elongate electrode body of carbon material having imbedded therein a core of luminous material and having about the outer surface thereof a metal coating;

said electrode body having a first support section of uniform diameter providing means to be grasped by said support, there being discrete contact areas between said support and said first support section;

said electrode body further comprising a second discharge section of a diameter substantially greater than the diameter of said first support section, said second discharge section having a solid uniform thickness throughout the entire length thereof.

4. The improvement claimed in claim 3, further comprising a radially extending annular shoulder joining said first and second sections, said shoulder providing shield means for covering said discrete contact areas.

* * * * *